United States Patent [19]

Pikna

[11] Patent Number: 4,508,488

[45] Date of Patent: Apr. 2, 1985

[54] WELL PUMP CONTROLLER

[75] Inventor: Richard G. Pikna, Mineral City, Ohio

[73] Assignee: Logan Industries & Services, Inc., New Philadelphia, Ohio

[21] Appl. No.: 568,098

[22] Filed: Jan. 4, 1984

[51] Int. Cl.[3] ..... F04B 49/00

[52] U.S. Cl. ..... 417/12; 417/18; 417/20; 417/44; 417/63

[58] Field of Search ..... 417/18–20, 417/22, 63, 12, 42–44

[56] References Cited

U.S. PATENT DOCUMENTS

| | | | |
|---|---|---|---|
| 2,296,833 | 9/1942 | Boynton . | |
| 3,266,574 | 8/1966 | Gandy . | |
| 3,678,997 | 7/1972 | Barchard . | |
| 3,851,995 | 12/1974 | Mills | 417/18 X |
| 4,118,148 | 10/1978 | Allen | 417/43 X |
| 4,119,865 | 10/1978 | Elderton | 417/43 X |
| 4,226,284 | 10/1980 | Evans . | |
| 4,286,925 | 9/1981 | Standish | 417/18 X |

*Primary Examiner*—Edward K. Look

*Attorney, Agent, or Firm*—Michael Sand Co.

[57] ABSTRACT

A device for automatically controlling the pumping of fluids from a well of the type using a walking beam and positive displacement pump to provide efficient utilization of the pumping equipment and energy required therefor, and to obtain efficient flow rates from the wall. A sensor detects the position of the walking beam at a predetermined position on the up-stroke of its pumping cycle and generates a signal to a control unit. A diaphram detects the pressure differential between the well casing pressure and the fluid delivery tube pressure. The diaphram moves a spring biased plunger which actuates a switch upon a predetermined pressure differential existing between the casing and delivery tube which sends a second signal to the control unit. The control unit upon receiving both signals maintains the pumping unit energizes until the pressure differential on the diaphram drops to a predetermined value preventing the plunger from actuating the switch. The control unit will deenergize the pumping unit if both signals are not received at the appropriate time. The sensitivity of the diaphram actuated switch is adjustable by changing the biasing force of the spring on the plunger.

14 Claims, 7 Drawing Figures

WELL PUMP CONTROLLER

TECHNICAL FIELD

The invention relates to controllers for positive displacement pumping units for wells. More particularly it relates to a controller which automatically determines when the pumping unit should be maintained energized to provide optimum pumping of the well and efficient use of the pumping equipment, and which will deenergize the well pumping equipment when this optimum condition ceases.

BACKGROUND ART

Most gas and oil wells today use either a positive displacement pump in which a pump or plunger is located within the delivery tube adjacent the bottom thereof, which tube is located within the well casing. The pump is moved by a pump rod which is connected to a walking beam located at ground level. Other types of wells will use the natural pressure in the well to force the fluid out of the well casing through the delivery tube and into a storage or sales line. Various controls have been devised for use with this latter type of well pumping or delivery system in which the pressure differential existing between the well casing and delivery tube is measured and upon reaching a predetermined differential amount will actuate the appropriate controls for opening the motor valve in the sales line. Opening of the motor valve will permit the natural pressure within the casing to force the fluid up and out of the delivery tube and into the sales line. Once actuated these wells will operate for a predetermined time period before shutting down automatically by a timer or the like. In other types the motor valve will shut down upon the pressure differential reaching a predetermined lower limit.

However, no such pressure differential sensing device has been used for controlling the pumping units of wells using a positive displacement pump. Heretofore, these positive displacement pump wells have used a mechanical timing device which actuates the well for a predetermined length of time at various time periods throughout the day. Another type uses a load sensing system in which a load cell is incorporated with the pump rod of the walking beam and monitors the lifting load on the rod in relationship to the plunger position. The load cell is connected to appropriate electronic controls for either maintaining the pumping unit energized or deenergizing the pumping unit upon certain load valves being obtained. These load cell control systems are relatively expensive and require installation of the cell in the pump rod and requires complex electronic circuitry for controlling the well from the signal received from the load cell.

Furthermore, existing timers that are used for controlling the pumping unit cannot adjust automatically for premature and/or successive pump off of fluids, and thus do not provide the most efficient utilization of the well.

There is no known controller of which I am aware that is used with a positive displacement pumping system for obtaining optimum pumping efficiency which uses the pressure differential existing between the pressure of the fluid in the well casing and in the delivery tube, in combination with the position of the walking beam for maintaining or deenergizing the pumping unit.

DISCLOSURE OF THE INVENTION

Objectives of the invention include providing an improved well pump controller which has a pressure differential sensor that contains a diaphram which measures the fluid pressure differential existing between the well casing pressure and delivery tube pressure for moving a spring loaded plunger to actuate a switch upon the pressure differential reaching a predetermined amount, and in which the switch when actuated supplies a signal to a control unit of the well pumping system.

Another objective is to provide such a well pump controller in which a sensor, such as a limit switch, is actuated by the walking beam of the well pumping unit when the walking beam reaches a predetermined position of its up-stroke, preferably 10° above the horizontal, and in which the switch when actuated during the upstroke will send a second signal to the control unit which will maintain the pumping unit energized or will deenergize the unit depending upon the presence or absence of the signal from the pressure differential sensor switch.

Another objective of the invention is to provide such a well pump controller in which the sensitivity of the pressure differential sensor is easily adjusted by regulating the amount of spring load exerted on the plunger which must be overcome by the diaphram to actuate the sensing switch.

A further objective is to provide such a pump controller in which the control unit consists of a logic circuit which determines if the pressure differential sensor switch is activated while the walking beam is at the predetermined position of its up-stroke for either maintaining the circuit to the pumping unit energized and the equipment running or if the required signals are not present to deenergize the pumping unit and shutting down the pump.

Still another objective is to provide such a pump controller unit in which the diaphram senses the pressure in the delivery tube and casing simultaneously in order to compensate for changes in gas pressure as a result of varying flow demands of the transport pipeline eliminating frequent adjustment of the spring load on the plunger to maintain a constant pump off pressure setting.

Another objective is to provide such a pump controller which is of a relatively inexpensive and durable construction, which is mounted at the well site closely adjacent to the well casing, and in which the control unit is comprised of relatively inexpensive solid state electronic circuitry all of which will be contained in protected enclosures at the well site.

A still further objective is to provide such a well pump controller which eliminates difficulties heretofore encountered with prior pump controllers which achieves the stated objectives simply and effectively and which will solve problems and satisfies needs existing in the art; and which can be used with both electric and gas driven pumping units.

These objectives and advantages are obtained by the well pump controller of the invention which is used with a well of the type having a well casing and a positive displacement pump located within a delivery tube within the well casing and in which the displacement pump is actuated by power driven walking beam, the general nature of said controller including: position sensing means for sensing the walking beam when at a predetermined position of its pumping stroke; first signal means generated by the position sensing means upon the walking beam reaching the predetermined position; pressure differential sensing means for sensing a predetermined pressure differential between the casing pressure and delivery tube pressure;

second signal means generated by the pressure differential sensing means upon the pressure differential reaching a predetermined amount; and control means responsive to said first and second signal means for maintaining the walking beam energized to continue the pumping operation.

BRIEF DESCRIPTION OF THE DRAWINGS

A preferred embodiment of the invention, illustrative of the best mode in which applicant has contemplated applying the principles, is set forth in the following description and shown in the drawings, and is particularly and distinctively pointed out and set forth in the appended claims.

Similar numerals refer to similar parts throughout the drawings.

BEST MODE FOR CARRYING OUT THE INVENTION

Figure 1:
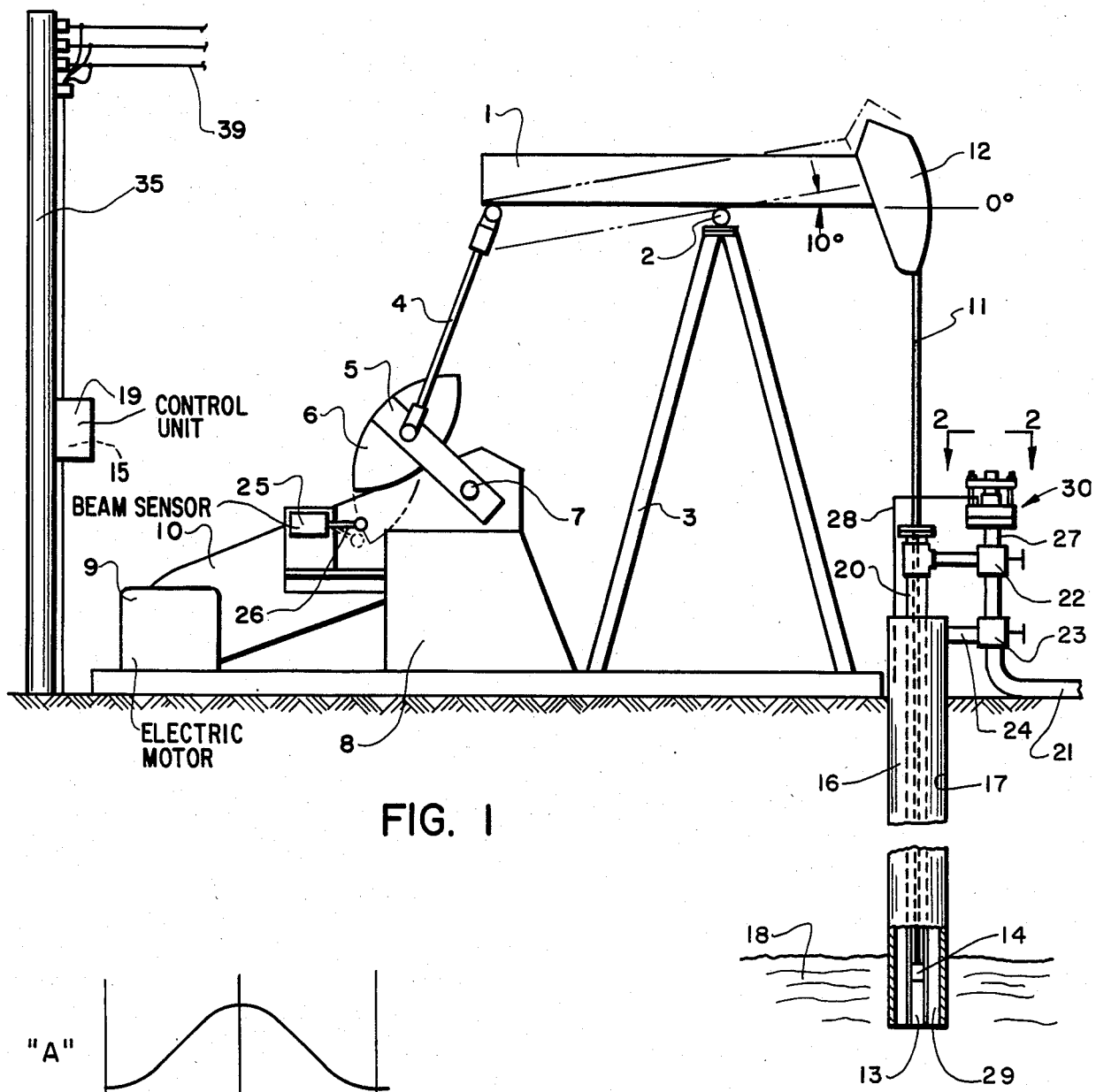
FIG. 1 is a diagrammatic elevational view showing a typical walking beam pumping unit operating a positive displacement pump located within the delivery tube of the well casing with the pump control unit being mounted adjacent thereto.

A typical positive displacement pump type of pumping system is shown in FIG. 1 in a general diagrammatic fashion and includes a walking beam 1 which is pivotally mounted at 2 on a support 3. Walking beam 1 is reciprocated by a rod 4 which is connected to the back end of beam 1 and to the outer end of a pittman arm 5 attached to an eccentric 6. Pittman arm 5 is mounted on and rotated by a power driven gear box and shaft 7 which is supported on a platform 8. An electric motor 9 rotates arm 5 and eccentric 6 through shaft 7 to reciprocate walking beam 1 on its pivot 2 for moving a pump rod 11 in a vertical reciprocal motion which is driven by a drive belt arrangement which is located within an enclosure guard 10 extending between motor 9 and platform 8.

Pump rod 11 extends to the lower end of and is located within a delivery tube 13 and is connected to a positive displacement pump or plunger 14. Delivery tube 13 is located within a well casing 16 which is located within a well bore hole 17 and extends to a predetermined depth into the oil producing strata 18.

The upper end of delivery tube 13 is connected to a discharge line 20 which is connected to a sales line 21 through a back pressure valve 22. The upper end of casing 16 also is connected to sales line 21 through a back pressure valve 23 and discharge line 24 (FIG. 1).

In accordance with one of the features of the invention, a sensor 25 is mounted adjacent eccentric 6 of the walking beam and may be in the form of a limit switch 26 which is actuated by eccentric 6 during each revolution thereof. Switch 26 is actuated when walking beam 5 is at a position on its up-stroke. It has been found that actuation of switch 26 when walking beam 5 is approximately 10° above the horizontal as shown in FIG. 1, is the preferred position for controlling the pumping unit to achieve optimum efficiency.

Other types of walking beam position sensing means may be used other than switch 26 without affecting the concept of the invention such as a mercury position switch or optical infrared device. The main feature of sensor 25 is that it senses when the walking beam reaches a predetermined position above horizontal on its upward stroke and provides a signal to a control unit indicated generally at 15. Control unit 15 preferably is mounted within a weatherproof protective enclosure 19 mounted on a power pole 35 located closely adjacent motor 9. A single phase 240 V AC power supply line 39 is connected to the top of pole 35 providing the electric supply to control unit 15 and motor 9.

Figure 2:
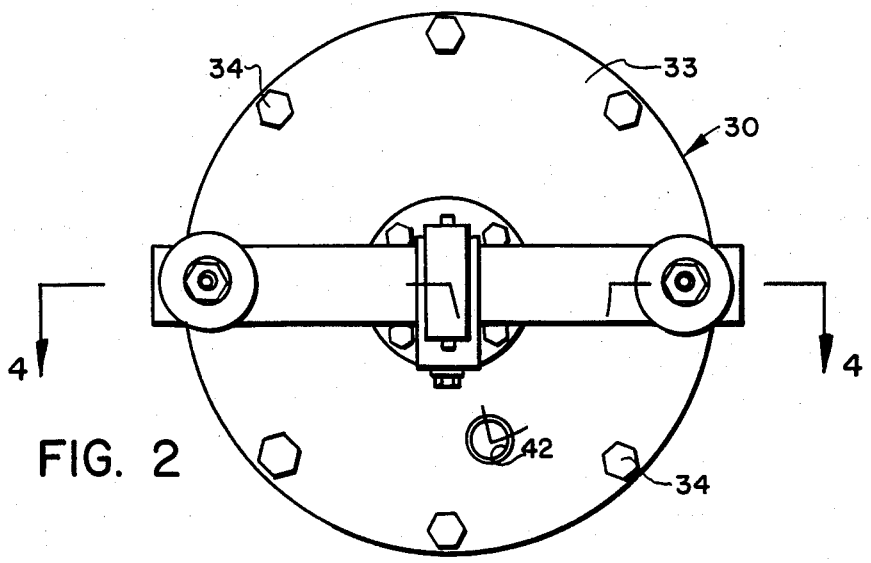
FIG. 2 is an enlarged top plan view of the improved pressure differential sensing means component of the well pump controller looking in the direction of arrows 2—2, FIG. 1.
Figure 3:
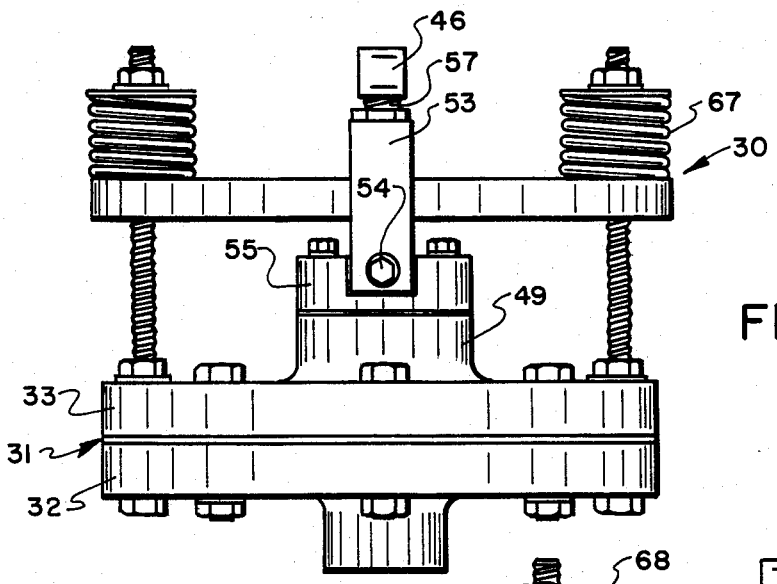
FIG. 3 is an elevational view of the pressure differential sensing means of FIG. 2.

In accordance with another feature of the invention, an improved pressure differential sensor indicated generally at 30, is mounted adjacent well casing 16 as shown in FIG. 1. Sensor 30 is shown particularly in FIGS. 2–4 and includes a two piece annular-shaped housing 31 having a bottom portion 32 and a top portion 33 secured together by a plurality of bolts 34. Top and bottom housing portions 32 and 33 are formed with interior annular recesses 36 and 37 respectively, which form a main recess 38 in which a diaphram 40 is mounted.

An inlet port 41 is provided in the bottom of housing portion 32 and is connected to delivery tube 13 and discharge line 20 by a nipple 27 as shown in FIG. 1 for applying the pressure within delivery tube 13 against the bottom of diaphram 40. A pressure inlet port 42 is formed in the housing top portion 33 and communicates with main recess 38 and diaphram 40. A conduit 28 extends between and communicates with inlet port 42 and annular space 29 which is located within well casing 16 and surrounds delivery tube 13 for applying the casing pressure against the top of diaphram 40.

Figure 4:
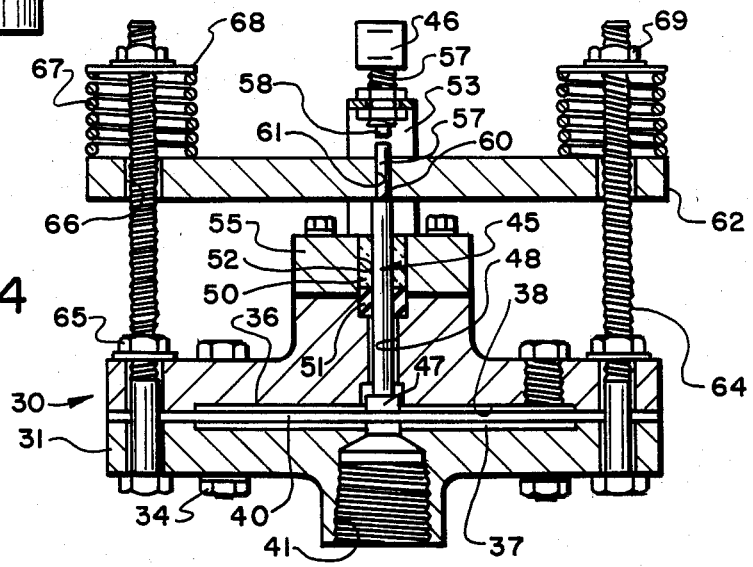
FIG. 4 is a sectional view taken on line 4—4, FIG. 2.

Diaphram 40, depending upon the pressure differential between the delivery tube pressure and casing pressure will move a plunger indicated generally at 45, toward a switch 46 (FIG. 4). Plunger 45 includes a plunger head 47 which is mounted on the lower end of the plunger and engageable with diaphram 40. Plunger 40 extends through a bore 48 formed in a central boss 49 of top housing portion 33. Plunger 45 is slidably supported within an enlarged bore 52 of end cap 55 by a bushing 50 with an annular seal 51 being mounted in the lower end of end cap bore 50.

Switch 46 is mounted on a bracket 53 which is attached by a bolt 54 to end cap 55. Switch 46 is of a usual construction having a threaded mounting sleeve 57 with a plunger 58 telescopically located within the sleeve and extending outwardly beyond for engagement by a top end of plunger 45 as shown in FIG. 4. Plunger 45 has a reduced diameter top end 57 which is separated from the lower portion of the plunger by an annular shoulder 60. Plunger end 59 extends through a complementary-shaped hole 61 formed in a pressure sensitivity bar 62.

Sensitivity bar 62 is supported on annular shoulder 60 of plunger 45 and is slidably mounted with respect to a pair of threaded posts 64 which are mounted on housing 31 by nuts 65 and extend upwardly therefrom in a spaced relationship. Posts 64 extend through enlarged holes 66 formed in the ends of bar 62. A pair of compression coil springs 67 are telescopically mounted on the upper ends of sensitivity bar posts 64 and are biased into engagement with bar 62 by retaining washers 68 and nuts 69.

Figure 6:
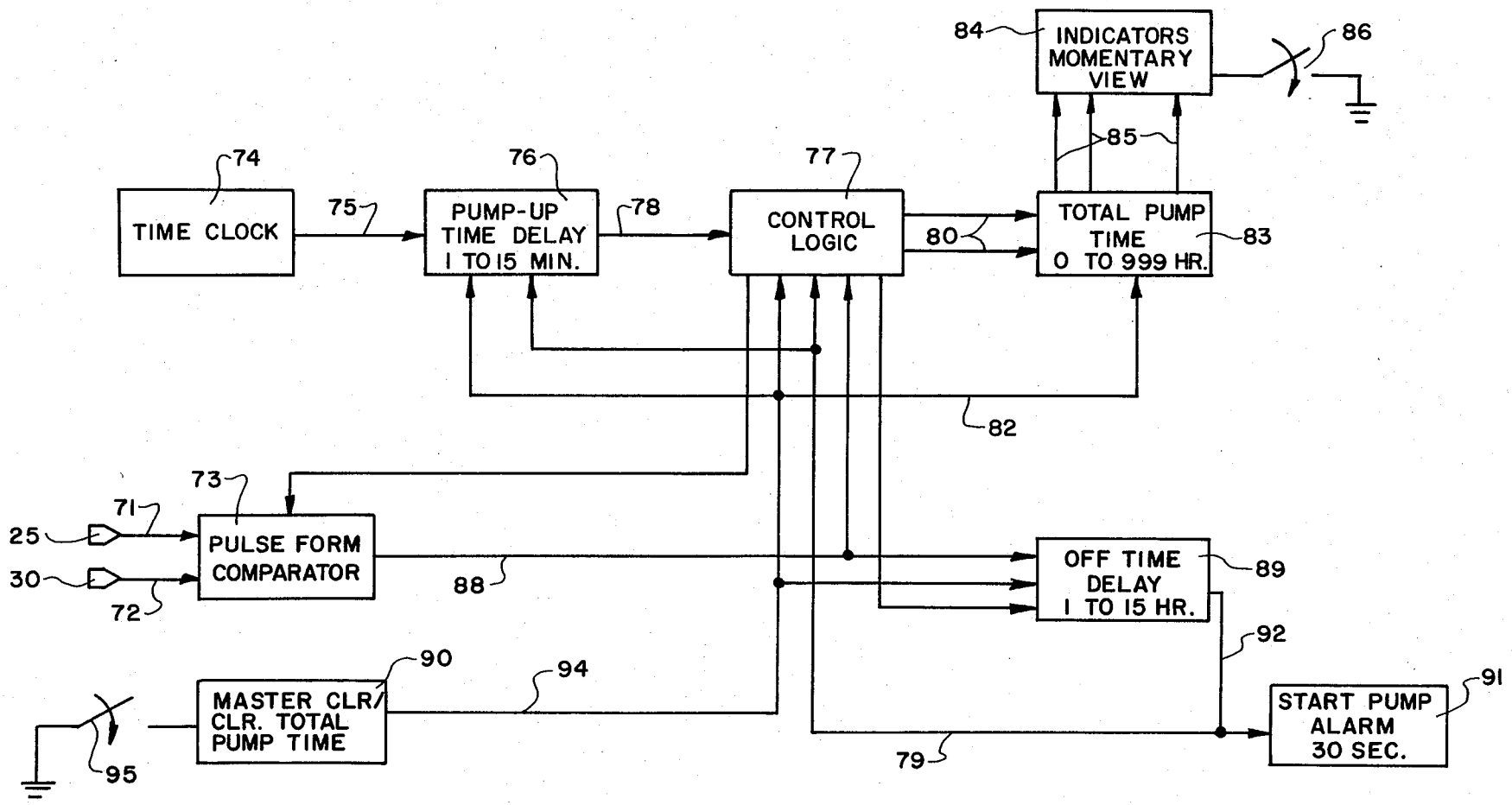
FIG. 6 is a block diagram of the logic circuits of the pump control means for a pumping unit.
Figure 7:
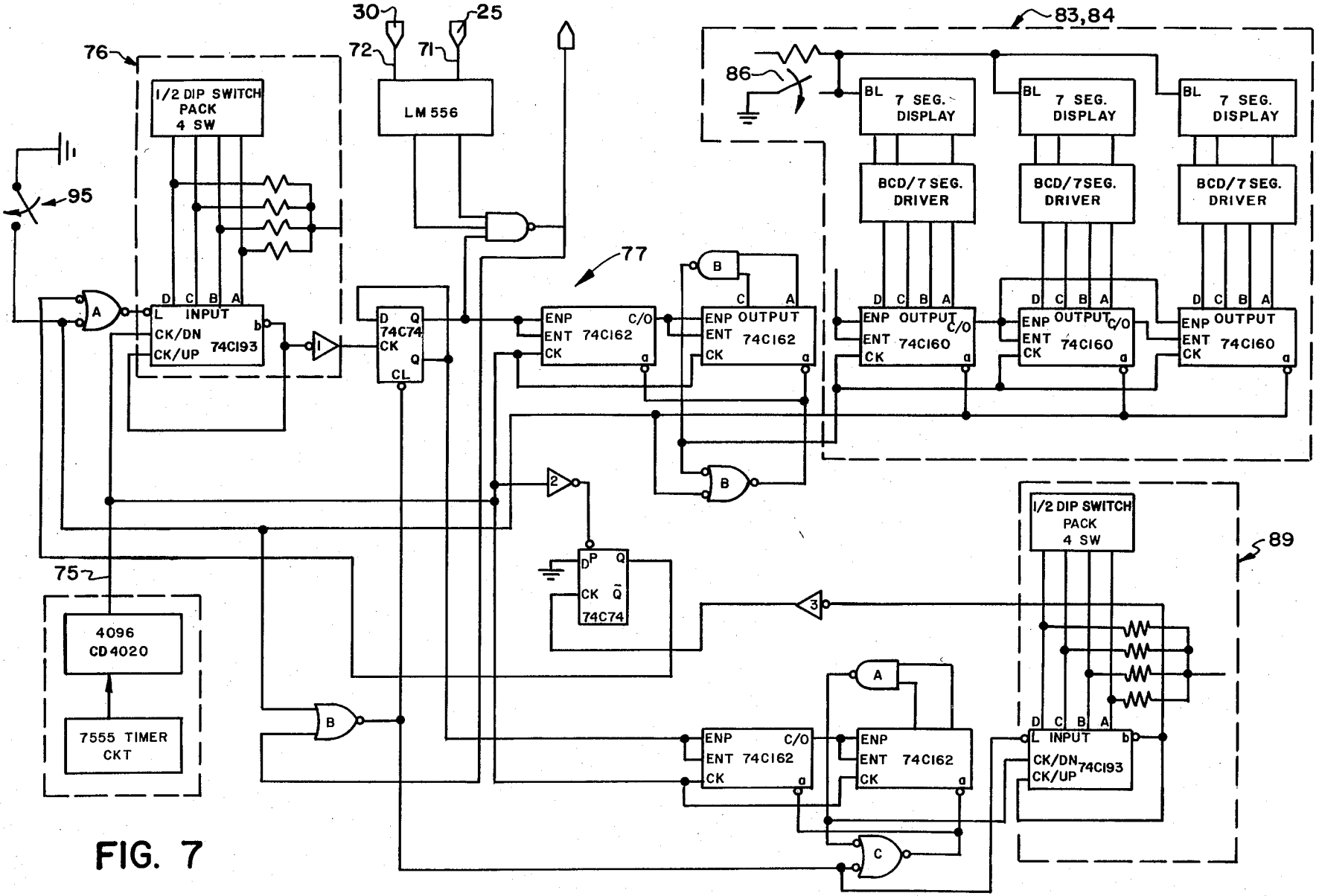
FIG. 7 is a schematic diagram of the control logic of the control unit shown in block diagram form in FIG. 6.

Control unit 15 preferably is formed of solid state electronic components and logic circuits, a preferred embodiment of which is shown in block diagram in FIG. 6 with details thereof being shown in FIG. 7. The particular control unit shown in FIGS. 6 and 7 is merely one example of electronic circuitry that can be used to achieve the results of applicant's pump unit. Control unit 15 provides a device which upon receipt of signals from walking beam position sensor 25 and pressure differential sensor 30 will maintain pump control motor 9 energized, and if these two signals are not present unit 25 will deenergize pump drive motor 9. Numerous other types of electronic circuits and components arrangements could accomplish this same function and the invention need not be limited to the particular circuitry shown in FIGS. 6 and 7.

Referring to FIG. 6, the incoming signal from walking beam sensor 25 and pressure differential sensor 30 are supplied through lines 71 and 72 to a pulse form comparator circuit 73. Prior to the receipt of any signal from sensors 25 and 30 to comparator 73 the pump control unit or motor 9 is manually started by an operator at the well site by manual actuation of a control button (not shown) or by the automatic start up feature of the control unit described below. This start up will energizes electric motor 9 starting the pumping operation of walking beam 1 and the associated components thereof.

Start up of motor 9 will energize a time clock 74 which is connected by a line 75 to a pump-up time delay 76. Time delay 76 is controlled by time clock 74 and is preset for a predetermined time period, for example between 1 and 15 minutes. The amount of time delay is depended upon the particular well. Time delay 76 enables the pumping action to continue the predetermined time period before control unit 15 becomes operative. This enables sufficient fluid to be pumped upwardly through delivery tube 13 toward the surface to obtain the necessary pressure on diaphram 40 for operation of sensor 30. If such a time delay was not present, the control unit would not sense the desired pressure in the manner described more fully below, and would immediately deenergize pump motor 9.

Upon passage of the predetermined time delay period the majority of the logic circuits of control unit 15 represented by block 77, is energized through line 78 or line 79. Pulse form comparator 73 then is operational for receiving the incoming signals from sensors 25 and 30 through lines 71 and 72, respectively. Thus, position sensor 25 will send a signal to comparator 73 through line 71 each time walking beam 1 is approximately 10° above horizontal on its up stroke as shown in FIG. 1. Likewise, if the predetermined amount of pressure differential exists between the casing pressure and tubing pressure, diaphram 40 will move plunger 45 a sufficient distance upwardly (FIG. 4) to actuate switch 46 providing a second signal through line 72 to comparator 73.

If the signal from pressure differential switch 30 is impressed upon comparator 73 at the time the signal is received from the walking beam sensor 25, comparator 73 will not send a de-energized signal to pump motor 9. This enables the pumping motor 9 to remain energized and the pumping operation continue for another cycle of walking beam 1. During the pumping operation, a signal is provided from control logic 77 through lines 80 to a time recorder 83 with records the number of hours that the pumping unit is energized. A visual time display 84 is connected with time recorder 83 through lines 85 providing a visual display upon manual actuation of a display button 86 of the total pump time accumulated. Preferably time recorder 83 will record up to 1000 hours with the actual accumulated time being displayed on display unit 84. This provides the pump operator with a constant monitoring of the well enabling him to accurately determine the productivity and amount of time that a well is operational. This information assists him in setting the time delay period of unit 76 and of an off-time delay unit 89.

Each up stroke of walking beam 1 will provide a signal to comparator 73 by actuation of sensor 25. Pump motor 9 will continue running until the pressure differential imposed on diaphram 40 falls below a predetermined value preventing diaphram 40 from overcoming the biasing force of springs 67 and moving plunger 45 upwardly the necessary amount to actuate switch 46. Comparator 73 upon sensing the signal from walking beam sensor 25 will deenergize well pump motor 9 by sending an appropriate signal through a line 88, if the appropriate signal is not received through line 72 from pressure differential sensor 30. This shut-off signal also is sent to off-time delay unit 89.

Delay unit 89 has a preset value therein, for example, between 1 and 15 hours, the amount of which is predetermined and set by the pump operator depending upon the characteristics of the particular well. Time delay 89 will energize pump motor 9 after passage of the shutdown time period. At the end of this time delay period, a signal will then be sent to the pump motor 9 which will start the pumping operation, subject to pump time delay 76 which must pass before comparator 73 is operative in the control circuit.

If desirable, a pump alarm 91 may be connected through line 92 to off-time delay 89 to provide a warning signal, for example, 30 seconds after the time delay has passed, before the pump is started. This alarm enables anyone at the pump site to get clear of the pumping equipment before it becomes energized to eliminate possible injury to personnel.

FIG. 7 shows in greater detail a type of a circuitry for the individual units and components shown in block form in FIG. 6. Again, these elements and circuit arrangement may be changed without affecting concept of the invention since numerous circuits may provide the same results as that shown therein. The control circuits are formed of usual integrated circuit chips (IC's) and control logic, represented by blocks 81, AND functions 82 and OR functions 87 in FIG. 7.

A master clear unit 90 also may be connected to the main control logic unit 77 by a line 94 (FIG. 6) which will clear all circuit counters, such as total pump time unit 83, upon actuation of a manual push button 95.

Figure 5:
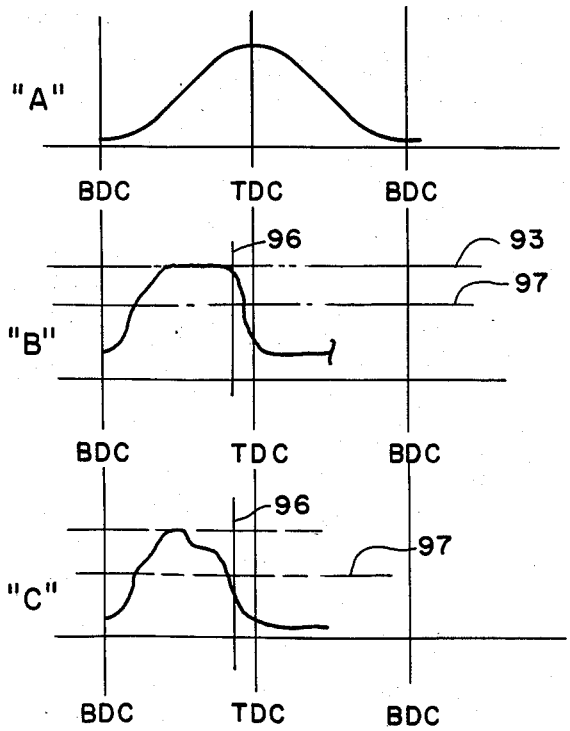
FIG. 5 is a fluid pressure profile of the crude oil throughout a pumping cycle.

The advantage of the improved pumping system may be better understood by a reference to FIG. 5 which shows the crude oil pressure profile during a pumping operation. The terms BDC on graphs A, B and C designates the "bottom dead center" position of positive displacement pump 14, and the term TDC designates the "top dead center" position of displacement pump 14 during its pumping cycle. Graph A shows the usual complete cycle of the positive displacement pump 14 from its bottom dead center to its top dead center and subsequent return again to the bottom dead center positions. Graph B shows the crude oil pressure profile during this corresponding movement for a condition in which control unit 15 will maintain pump motor 9 energized. Graph C shows the crude oil pressure profile during a pumping cycle when control unit will deenergize motor 9.

The pressure of the crude oil in delivery tube 13 upon reaching a predetermined level indicated by line 93 lining the upstroke of walking beam 1 is sufficient to open the back pressure valve 22 to permit the fluid to be discharged through sales line 21 as described above. As displacement pump 14 continues its upward movement by walking beam 12 and pump rod 11, it will continue to discharge the fluid above the displacement pump and maintain this discharge pressure until nearly exhausting the supply of oil in the pump during the up stroke. So long as the pressure in delivery tube 13 is sufficiently great enough after the walking beam passed the 10° horizontal on the upstroke, indicated by line 96 in Graphs B and C of FIG. 5, it will maintain the pump energized to continue another pumping cycle. This condition is shown in Graph B in which the tubing pressure is great enough to provide a sufficient pressure differential with the casing pressure to continue to pumping operation since enough fluid is in delivery tube for the walking beam to progress through another stroke.

Graph C of FIG. 5 indicates that immediately upon the fluid pressure reaching the level indicated by line 93 and opening the back pressure valve in the sales line, the amount of fluid in delivery tube is insufficient to maintain the desired pressure as shown by the rapid drop-off of the pressure. The pressure drops immediately below the level indicated by line 97 which will cause the pressure differential to drop below the amount necessary to actuate switch 46. Thus, when the fluid pressure follows that of Graph C, switch 46 will not be actuated and accordingly, no signal is supplied to comparator 73 which will immediately deenergize pump motor 9 when the position signal is received from walking beam sensor 25. This is desirable since not enough fluid is present in the delivery tube to maintain the pumping operation since this fluid amount determines the pressure which will not drop below the predetermined lower limit immediately upon opening of the back pressure discharge valve.

It has been determined that when the walking beam is at the 10° above horizontal position of its upstroke, the resulting pressure provides the best reading of the fluid in delivery tube 13 for determining whether the pumping action should continue through another cycle. Although this position is indicated as being 10°, this position may vary without affecting the concept of the invention since different wells may provide a better optimum pumping signal at a different position for taking the pressure differential reading for determining pump operation.

Futhermore, the sensitivity of pressure differential sensor 30 can be adjusted easily by changing the biasing force exerted by springs 67 on bar 62 and on plunger 45 by movement of nuts 69 along threaded posts 64. Likewise, the control logic preferably will be CMOS logic and has a very low power consumption and does not require voltage regulation. This will enable control unit 15 to operate for long periods of time if desired off batteries. If desired, control unit 15 can be composed of mechanical and electromechanical relays and associated circuitry and will still provide the same results as that of the electronic logic circuitry. Also, the improved well pump controller can be used with both electric and gas driven wells. In the gas driven units, electric motor 9 is replaced by a natural gas driven engine for reciprocating and driving the walking beam.

Accordingly, the improved well pump controller provides a highly efficient and satisfactory device for use with a positive displacement type of oil well pumping unit to provide optimum use of the well pumping eqiupment by maintaining the pump energized only during the maximum oil producing periods of the well; and in which this condition is determined by the pressure differential between the well casing pressure and delivery tube pressure with respect to the position of the walking beam by a relatively inexpensive, durable and efficient control mechanism and associated control logic.

Accordingly, the improved well pump controller is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved well pump controller is constructed and used, the characteristics of the construction, and the advantageous, new and useful results obtained; the new and useful structures, devices, elements, arrangements, parts and combinations, are set forth in the appended claims.

What is claimed is:

1. A well pump controller for a well of the type having a well casing and a positive displacement pump located within a delivery tube within said well casing, and in which the displacement pump is actuated by a power driven walking beam, said controller including:

(a) position sensing means for sensing the walking beam when at a predetermined position of its pumping stroke;

(b) first signal means generated by the position sensing means upon the walking beam reaching the predetermined position;

(c) pressure differential sensing means for sensing a predetermined pressure differential between the casing pressure and delivery tube pressure;

(d) second signal means generated by the pressure differential sensing means upon the pressure differential reaching a predetermined amount; and (e) control means responsive to said first and second signal means for maintaining the walking beam energized to continue the pumping operation.

2. The well pump controller defined in claim 1 in which the position sensing means is a switch activated by the movement of the walking beam.

3. The well pump controller defined in claim 1 in which the pressure differential sensing means includes a diaphram operatively communicating with the delivery tube and well casing and moveable in response to the pressure differential existing between the fluids in the delivery tube and well casing; and a switch actuated by a predetermined amount of movement of the diaphram in response to the pressure differential to provide the second signal means.

4. The well pump controller defined in claim 3 in which the switch is operatively connected to the diaphram by a plunger; and in which spring means is engageable with the plunger for biasing the plunger away from the switch for regulating the amount of pressure differential required for actuating the switch.

5. The well pump controller defined in claim 4 in which the spring means includes a sensitivity bar engageable with the plunger and a pair of springs biasing said bar away from the switch.

6. The well pump controller defined in claim 5 in which the pair of springs are adjustably mounted with respect to the switch for adjusting the biasing force exerted by the springs on the sensitivity bar.

7. The well pump controller defined in claim 4 in which the pressure differential sensing means further includes a housing formed with a circular-shaped cavity; in which the diaphram is located in the cavity; and in which a pair of inlet ports are formed in the housing and communicate with opposite sides of the cavity and with the delivery tube and well casing for applying the fluid pressure within said tube and casing to opposite sides of the diaphram.

8. The well pump controller defined in claim 1 in which the control means includes a comparator for receiving the first and second signals and initiating a pump motor signal in response to said first and second signals.

9. The well pump controller defined in claim 8 in which the control means includes pump-up timer delay means for preventing the comparator from initiating the pump motor signal in response to the first and second signals until passage of a predetermined time delay period after actuation of the displacement pump.

10. The well pump controller defined in claim 8 in which the control means includes time recording means for recording the total time that the displacement pump is operating.

11. The well pump controller defined in claim 8 in which the walking beam is power driven by an electric motor; and in which the control means includes pump off time delay means for preventing the walking beam electric motor from being energized until passage of a predetermined time period after said motor has been deenergized by the control means in response to the lack of the second signal means.

12. The well pump controller defined in claim 11 in which alarm means is connected to the pump off time delay means for sounding an audible alarm after passage of the predetermined time off period and just prior to energizing the electric motor.

13. The well pump controller defined in claim 1 in which the position sensing means is activated when the walking beam reaches a position of approximately 10° above horizontal on its upstroke.

14. A well pump controller for a well of the type having a well casing and a positive displacement pump located within a delivery tube within said well casing, and in which the displacement pump is actuated by a walking beam driven by an electric motor; said controller including:

(a) position sensing means for sensing the walking beam when at a predetermined position of its pumping stroke;

(b) first signal means generated by the position sensing means upon the walking beam reaching the predetermined position;

(c) pressure differential sensing means for sensing a predetermined pressure differential between the casing pressure and delivery tube pressure;

(d) second signal means generated by the pressure differential sensing means upon the pressure differential reaching a predetermined amount; and (e) control means responsive to the presence or absence of said first and second signal means for maintaining the walking beam drive motor energized to continue the pumping operation or for deenergizing said drive motor to stop said pumping operation.

* * * * *